US012070058B2

(12) United States Patent
Mishra et al.

(10) Patent No.: US 12,070,058 B2
(45) **Date of Patent: *Aug. 27, 2024**

(54) SMOKING ARTICLE

(71) Applicant: Altria Client Services LLC, Richmond, VA (US)

(72) Inventors: Munmaya K. Mishra, Manakin Sabot, VA (US); Shaoyong Yu, Glen Allen, VA (US)

(73) Assignee: Altria Client Services LLC, Richmond, VA (US)

( * ) Notice: Subject to any disclaimer, the term of this patent is extended or adjusted under 35 U.S.C. 154(b) by 5 days.

This patent is subject to a terminal disclaimer.

(21) Appl. No.: 17/980,052

(22) Filed: Nov. 3, 2022

(65) Prior Publication Data

US 2023/0059475 A1 Feb. 23, 2023

Related U.S. Application Data

(63) Continuation of application No. 15/631,581, filed on Jun. 23, 2017, now Pat. No. 11,490,653.

(51) Int. Cl.

| | |
|---|---|
| ***A24D 3/06*** | (2006.01) |
| ***A24D 1/00*** | (2020.01) |
| ***A24D 1/04*** | (2006.01) |
| ***A24D 3/18*** | (2006.01) |

(52) U.S. Cl.

CPC ..... *A24D 3/06* (2013.01); *A24D 1/002* (2013.01); *A24D 1/042* (2013.01); *A24D 1/045* (2013.01); *A24D 3/18* (2013.01)

(58) Field of Classification Search

None

See application file for complete search history.

(56) References Cited

U.S. PATENT DOCUMENTS

| | | | |
|---|---|---|---|
| 3,545,448 | A | 12/1970 | Troon |
| 3,556,109 | A | 1/1971 | Briskin et al. |
| 3,556,110 | A | 1/1971 | Briskin et al. |
| 3,638,660 | A | 2/1972 | Davis |
| 3,807,414 | A | 4/1974 | Hedge |
| 3,861,401 | A | 1/1975 | Briskin et al. |
| 3,878,850 | A | 4/1975 | Gibson et al. |
| 3,902,504 | A | 9/1975 | Owens, Jr. et al. |
| 3,931,824 | A | 1/1976 | Miano et al. |
| 3,943,940 | A | 3/1976 | Minami |
| 3,943,941 | A | 3/1976 | Boyd et al. |
| 3,951,155 | A | 4/1976 | Prouse et al. |
| 3,987,791 | A | 10/1976 | Chittenden et al. |
| 3,993,082 | A | 11/1976 | Martin et al. |
| 4,014,349 | A | 3/1977 | Morman et al. |
| 4,019,521 | A | 4/1977 | Briskin |
| 4,044,777 | A | 8/1977 | Boyd et al. |

(Continued)

FOREIGN PATENT DOCUMENTS

| | | | |
|---|---|---|---|
| CN | 101942102 | A | 1/2011 |
| CN | 101942102 | B | 5/2012 |

*Primary Examiner* — Phu H Nguyen

(74) *Attorney, Agent, or Firm* — Harness, Dickey & Pierce, P.L.C.

(57) ABSTRACT

A smoking article has a burn portion and a mouth portion. The burn portion includes a smoking rod filled with a smokeable filler material formed almost exclusively of cellulose material. The mouth portion includes either a filter portion with or without an interface or a tip with an interface. The mouth end may include an orthonasal property and the interface may store an additive.

23 Claims, 7 Drawing Sheets

(56) References Cited

U.S. PATENT DOCUMENTS

| | | | |
|---|---|---|---|
| 4,079,742 | A | 3/1978 | Rainer et al. |
| 4,119,104 | A | 10/1978 | Roth |
| 4,296,762 | A | 10/1981 | Eicher et al. |
| 4,333,484 | A | 6/1982 | Keritsis |
| 4,506,684 | A | 3/1985 | Keritsis |
| 4,942,888 | A | 7/1990 | Montoya et al. |
| 5,046,514 | A | 9/1991 | Bolt |
| 5,159,940 | A | 11/1992 | Hayward et al. |
| 5,322,075 | A | 6/1994 | Deevi et al. |
| 5,497,792 | A | 3/1996 | Prasad et al. |
| 5,591,368 | A | 1/1997 | Fleischhauer |
| 5,934,289 | A | 8/1999 | Watkins et al. |
| 5,996,589 | A | 12/1999 | St. Charles |
| 6,041,789 | A | 3/2000 | Bankert et al. |
| 6,053,176 | A | 4/2000 | Adams et al. |
| 6,257,243 | B1 | 7/2001 | Muller et al. |
| 7,428,905 | B2 | 9/2008 | Mua |
| 7,578,298 | B2 | 8/2009 | Karles et al. |
| 7,836,896 | B2 | 11/2010 | Nadimi et al. |
| 8,235,056 | B2 | 8/2012 | Zhuang et al. |
| 8,240,315 | B2 | 8/2012 | Olegario et al. |
| 8,282,739 | B2 | 10/2012 | Mishra et al. |
| 8,573,230 | B2 | 11/2013 | Zhuang et al. |
| 8,671,951 | B2 | 3/2014 | Ercelebi et al. |
| 8,905,037 | B2 | 12/2014 | Lipowicz et al. |
| 9,066,541 | B2 | 6/2015 | Allen et al. |
| 9,185,935 | B2 | 11/2015 | Lewis et al. |
| 9,370,160 | B2 | 6/2016 | Xu et al. |
| 2006/0021626 | A1 | 2/2006 | Mua |
| 2008/0000488 | A1 | 1/2008 | Nadimi et al. |
| 2008/0029106 | A1 | 2/2008 | Mishra et al. |
| 2009/0014020 | A1 | 1/2009 | Yoss et al. |
| 2010/0108084 | A1 | 5/2010 | Norman et al. |
| 2011/0259352 | A1 | 10/2011 | Woodcock et al. |
| 2012/0037172 | A1 | 2/2012 | Allen et al. |
| 2014/0202478 | A1 | 7/2014 | Awty et al. |
| 2016/0205996 | A1 | 7/2016 | John et al. |
| 2016/0374387 | A1 | 12/2016 | Adams et al. |

SMOKING ARTICLE

CROSS-REFERENCE TO RELATED APPLICATION(S)

This application is a continuation application of U.S. application Ser. No. 15/631,581, filed Jun. 23, 2017, the entire contents of which are incorporated herein by reference.

FIELD OF THE INVENTION

The present disclosure is related to a smoking article, and particularly a smoking article having a non-tobacco smokeable material as the filler.

BACKGROUND

Traditional cigarettes generally include a tobacco rod having shredded tobacco and a filter. When burned, the tobacco is known to expel toxins in mainstream and sidestream smoke. The filter is used to reduce the amount of toxin in the mainstream smoke by having embedded particles or regions designed to react with certain constituent particles of the mainstream smoke. A number of smoking articles have been produced that use a different filler materials in the tobacco rod as a tobacco substitute. The tobacco substitutes have been used in many forms and many different material combinations including being combined with natural tobacco. The taste and burning characteristics of the tobacco substitutes often require the use of additives to enhance the flavor, taste, and burn rate, among other properties and characteristics. The use of additives can be directly proportional to increases in filter complexity, production time, and production costs of these smoking alternatives.

SUMMARY

An exemplary smoking article comprises a burn portion; and a mouth portion, wherein the burn portion includes a smoking rod filled with a smokeable filler material consisting essentially of cellulose material, and wherein the mouth portion includes a filter.

Another exemplary smoking article, comprises a smoking rod filled with a smokeable filler material consisting essentially of a cellulose material; and a mouth portion connected to an end of the smoking rod, the mouth portion including an interface adjacent to the smoking rod for storing at least one additive and a filter for filtering mainstream smoke.

An exemplary smoking article, comprises a burn portion; and a mouth portion, wherein the burn portion includes a smoking rod filled with a smokeable filler material consisting essentially of cellulose material, and wherein the mouth portion includes an interface and a tip detachably connected to the interface.

Still another exemplary smoking article, comprises a burn portion; and a mouth portion, wherein the burn portion includes a smoking rod filled with a smokeable filler material consisting essentially of cellulose material and an elongated additive insert that is fully inserted into the smoking rod, and wherein the mouth portion includes a filter.

BRIEF DESCRIPTION OF THE DRAWINGS

Within the following description of the drawings, the same reference numbers refer to the same or to similar components. Generally, only the differences with respect to the individual exemplary embodiments are described. Unless specified otherwise, the description of a part or aspect in one embodiment applies to a corresponding part or aspect in another embodiment as well. The scope of the present disclosure is best understood from the following detailed description of exemplary embodiments when read in conjunction with the accompanying drawings, wherein.

DETAILED DESCRIPTION

Figure 1A:
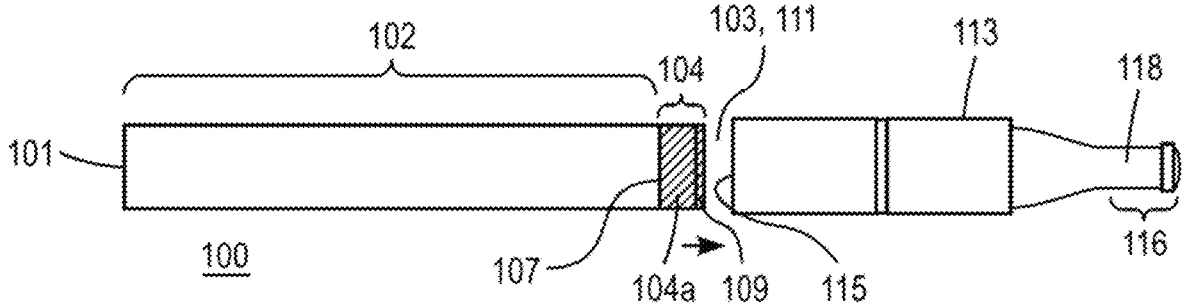
FIG. 1*a* illustrates a first smoking article in accordance with an exemplary embodiment of the present disclosure.

Reference will now be made in detail to the various embodiments, one or more examples of which are illustrated in each figure. Each example is provided by way of explanation and is not meant as a limitation. For example, features and/or method steps illustrated or described as part of one embodiment and/or method can be used on or in conjunction with other exemplary embodiments and/or method steps to yield yet further exemplary embodiments or methods. It is intended that the present disclosure includes such modifications and variations.

Exemplary embodiments of the present disclosure are directed to a smoking article having a non-tobacco or tobacco-less material or tobacco substitute as the smokeable filler material (e.g., smoking material). In particular, the filler material can consist essentially of a cellulose material. The smokeable filler material can be formed in a smoking rod that is wrapped with a known cigarette wrapping paper. The smoking article includes an interface connected to the smoking rod on a mouth end of the smoking article. The interface can be arranged to releasably store an additive such as flavoring or nicotine. The additive is released by virtue of the temperature of the mainstream smoke exiting the smoking rod. A filter can be connected to the interface such that the interface is arranged between the smoking rod and the filter. The filter can include material, such as cellulose acetate, polypropylene, or paper that is suitable for filtering mainstream smoke. The filter can include flavoring that can be released due to the temperature of the mainstream smoke passing through the filter from the burn end or released on-demand by the adult smoker during smoking. The exemplary smoking article, as will be described in further detail herein, produces mainstream and sidestream smoke that are devoid of many toxic constituents normally generated by traditional tobacco cigarettes. The use of fewer additives also allows the exemplary smoking articles described herein to have less complexity leading to a more cost-effective and safer smoking solution over traditional tobacco cigarettes.

The term "mainstream smoke" includes the mixture of gases and/or aerosols passing end-to-end through an exemplary smoking article of the present disclosure. For example, in traditional tobacco cigarettes the mainstream smoke passes from a burn end through a smoking rod, and issues from a mouth end through a filter portion opposite the burn end. This flow establishes the amount of smoke issuing or drawn from the mouth end of a smoking article during smoking. The mainstream smoke contains air that is drawn in through the heated region of the smoking article and through the paper wrapper.

The term "sidestream smoke" describes smoke that flows directly into the air from the burn end of the smoking article during smoking. Sidestream smoke can include many components such as carbon monoxide, nicotine, hydrogen, and other additives present in the smoking article. The compositional makeup of the cellulose smoking material used in the exemplary smoking articles of the present disclosure releases fewer toxins in the sidestream smoke as compared to traditional tobacco cigarettes.

"Smoking" of an exemplary smoking article of the present disclosure is intended to mean the heating (e.g., thermal heating), combusting or otherwise causing chemical reactions in the smoking material and release of byproducts from the smoking material. Generally, the act of smoking the smoking article involves igniting the burn end of the smoking rod and drawing the mainstream smoke through the smoking rod and out of the mouth end of the smoking article. During smoking, the smoking material contained in the smoking rod undergoes combustion, pyrolysis or distillation of volatiles. However, as with a traditional tobacco cigarette, the smoking material may also be smoked by other means. For example, the smoking article may be smoked by heating the burn end of the smoking rod via an electrical heater, as described, for example, in commonly-assigned U.S. Pat. Nos. 6,053,176; 5,934,289; 5,591,368 or 5,322,075, each of which is incorporated herein by reference in its entirety.

In traditional tobacco cigarettes, the term "sorption" denotes a function of a filter involving filtration by adsorption and/or absorption. Sorption is intended to encompass interactions on the outer surface of a sorbent, as well as interactions within the pores and channels of the sorbent. In other words, a "sorbent" is a substance that may condense or hold molecules of other substances on its surface, and/or take up other substances, i.e., through penetration of the other substances into its inner structure, or into its pores. Sorbents are used in the filter to perform adsorption and/or absorption functions and remove at least some portion of a constituent of mainstream tobacco smoke. For example, known sorbent materials include sorbent materials may include, but are not limited to, carbons such as activated carbon, aluminas, silicates, molecular sieves, and zeolites.

Microporous sorbents are known to adsorb and/or absorb flavor components present in filter materials during the time between cigarette manufacturing and, thus reducing the effectiveness of the flavor components in traditional cigarettes. In accordance with exemplary embodiments described herein, sorbents are not necessary for removing constituents of mainstream smoke. That is, because the exemplary smoking articles of the present disclosure use a non-tobacco or tobacco-less material or tobacco substitute as the smoking material, many if not all of the toxins generally present in the mainstream smoke of tobacco smoking material are absent as these constituents are not generated through the burning of cellulose material.

The term "additive" means any material or component which modifies the characteristics of the smoking material of the smoking article during smoking. Any appropriate additive material or combination of materials may be contained within an additive insert, and/or inside one or more capsules, beads, or liquids to modify the characteristics of a smoking article of the present disclosure and provide automatic or on-demand release of nicotine and/or flavoring into the smoking article by the adult smoker. Such additive materials can include flavors, neutralizing agents, and other smoke modifiers, such as chemical reagents like 3-aminopropylsilyl (APS) which interacts with smoke constituents. Additionally, the additive materials may also include diluents, solvents or processing aids that may or may not impact the sensorial attributes of the mainstream smoke but aid in processing of an additive and its placement, encapsulation, and/or presentation in the smoking article. Additives can be provided in liquid and/or solid form. As disclosed herein, additives can include, but are not limited to, flavorants, nicotine, diluents, humectants or combinations thereof.

According to an exemplary embodiment of the present disclosure, the additive materials may include one or more flavors, such as liquid or solid flavors and flavor formulations or flavor-containing materials. The term "flavor" may include any flavor compound or tobacco extract suitable for being releasably disposed in liquid or immobilized form within an insert, beads, and single- or multi-part macrocapsules or microcapsules. The flavor additives enhance the taste of mainstream smoke produced, for example, by the smoking article. In particular, the flavor additive can also reduce and/or eliminate bad mouth feel, after taste, and/or bad breath. For example, an additive containing insert, bead, or capsule may be at least partially combusted or ruptured along with the smoking rod of a smoking article during smoking to release additives from the insert, bead, and/or capsule into the smoke produced.

Suitable flavors or flavorings include, but are not limited to menthol, mint, such as peppermint and spearmint, chocolate, licorice, citrus and other fruit flavors, gamma octalactone, vanillin, ethyl vanillin, breath freshener flavors, spice flavors such as cinnamon, methyl salicylate, linalool, bergamot oil, geranium oil, lemon oil, ginger oil, and tobacco flavor. Other suitable flavors may include flavor compounds selected from the group consisting of an acid, an alcohol, an ester, an aldehyde, a ketone, a pyrazine, combinations or blends thereof and the like. Suitable flavor compounds may be selected, for example, from the group consisting of phenylacetic acid, solanone, megastigmatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, iso-valeric acid, combinations thereof and the like.

By incorporating the additive material in inserts, or one or more beads or capsules, loss of flavor to side stream smoke is substantially reduced during the smoking of the smoking article.

During smoking additive materials in beads can be released in response to the temperature of mainstream smoke passing from the burn end to the mouth end of the smoking article. As will be discussed in detail in accordance with exemplary embodiments of the present disclosure, the beads are disposed in an area of the smoking article where the mainstream smoke exiting the smoking rod is at its highest temperature. As a result, thermal heating of the beads occurs via the mainstream smoke, which causes the casing of the beads to rupture thereby releasing the flavoring for mixing with the mainstream smoke.

Additive materials in flavor capsules can be releasably disposed on-demand such that the additive materials are sufficiently contained to substantially avoid or minimize unwanted migration to other areas of the smoking article, such as during storage. Moreover, additive materials provided in capsule form can be mobile enough to be released on-demand from the flavor capsule when, for example, the capsule is broken or opened by mechanical force. For example, the flavor capsule may be broken by squeezing a portion of a cigarette filter containing the flavor capsule, thus releasing the additive material stored therein.

As already discussed, the additives may be implemented in a variety of physical forms including inserts, small or large beads, singular part or multipart capsules, large capsules, small capsules, microcapsules, macrocapsules, etc. The nicotine and/or flavoring may be present in the smoking material of the burn portion (e.g., smoking rod) or the mouth portion of the exemplary smoking article described herein. The mouth portion including an interface or filter plug. The additives can be provided in a dispersed or densely packed arrangement based any one or combination of the form or size of the additive packaging (e.g., small and/or large beads or capsules), the size of the space in which the additive will be disposed, and the amount of additive desired for release during smoking.

The beads and capsules may be formed by any suitable technique including encapsulation techniques, such as spin coating, coacervation, interfacial polymerization, solvent evaporation, annular jet forming, which uses two concentric jets to eject an inner jet of liquid core material and an outer jet of liquid wall material where the fluid stream breaks into droplets and the liquid wall material solidifies by phase transition induced by the presence of cross-linking ions, pH differences, temperature changes, or other conditions as desired.

The capsules or beads can be formed as single wall or multi-wall capsules, which can be used based on capsule stability, strength, rupture resistance, processing ease in filter making, or other factor as desired, and be made of any suitable material, such as a gelatin-based material, or a polymeric material, such as modified cellulose (e.g., hydroxypropylmethyl cellulose).

Figure 1B:
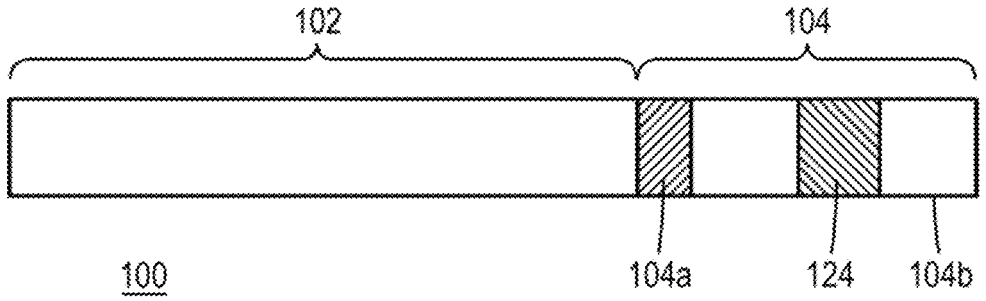
FIG. 1*b* illustrates a second smoking article in accordance with an exemplary embodiment of the present disclosure.
Figure 1C:
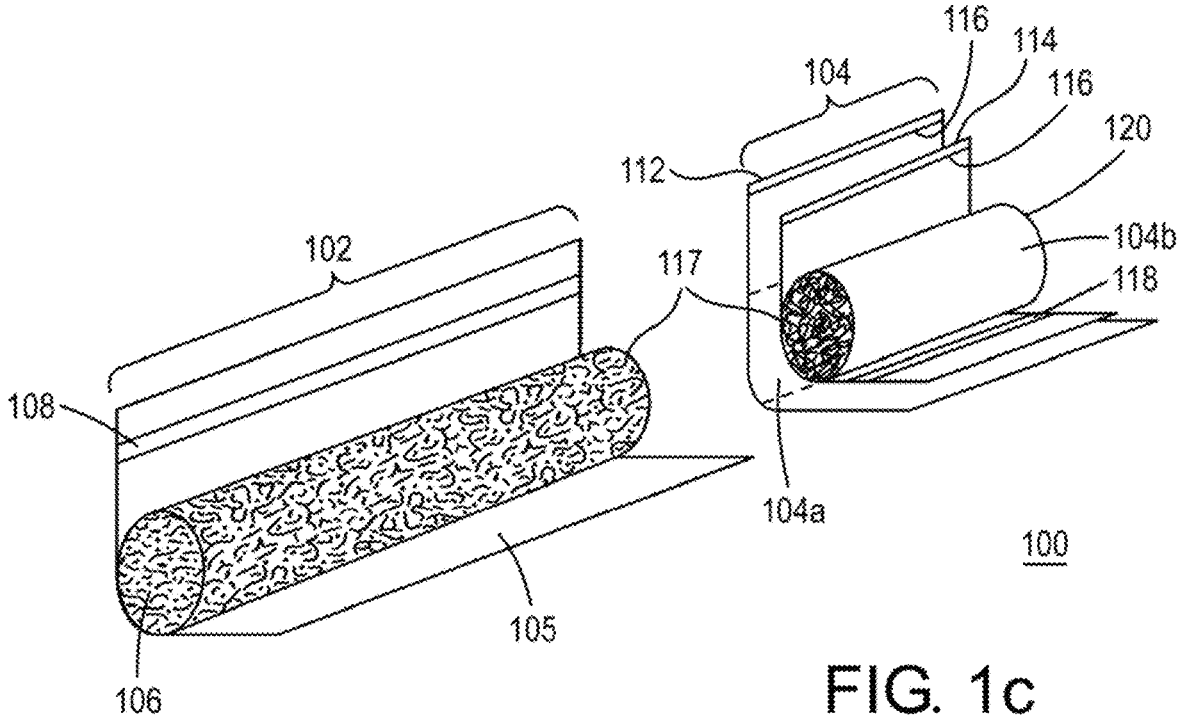
FIG. 1*c* illustrates an exploded view of the second smoking article in accordance with an exemplary embodiment of the present disclosure.

FIGS. 1*a*-1*c* illustrate smoking articles in accordance with an exemplary embodiment of the present disclosure. As shown in FIG. 1*a*, the smoking article 100 is substantially in the shape of a cylinder. The smoking article 100 includes two sections—a burn portion 102 including the smoking rod and a mouth portion 104. An exposed end of the burn portion 102 forms a burn end 101 and an exposed end of the mouth portion 104 forms a mouth end 103. The burn portion 102 includes a smoking rod formed of smoking material 106 (FIG. 1*c*) consisting of a biopolymer material such as cellulose. The cellulose material can include wood, jute, ramie, hemp, tree bark, cotton, or cotton-based material, or any other suitable cellulose material, cellulosic material, cellulosic-derived material, or any combination thereof as desired. According to an exemplary embodiment of the present disclosure, the smoking material 106 can contain a cellulose material consisting essentially of cotton or cotton-based material. The smoking material 106 used in the smoking rod can be in the form of a pre-formed rigid rod, shredded fibers, woven strands, filament, or any other suitable form as desired. According to an exemplary embodiment, the smoking material 106 can be prepared from known cellulose filter papers made of high quality cotton linters having a minimum alpha cellulose content of 98%. The cellulose filter paper is of ashless grade having an extremely low ash content. For example, according to exemplary embodiment described herein, the ash content can be less than or equal to 0.1% (e.g., 0.005%), between 0.1% and 0.15%, or less than 0.04% (e.g., 0.005%, 0.007%, 0.01%). Prior to placement in the smoking rod, the filter paper can be shredded into a form similar in appearance to shredded tobacco used in traditional cigarettes.

As shown in FIG. 1*a*, the mouth portion 104 can include an interface 104*a*. The interface 104*a* is formed as a hollow or empty volume and is used to store an additive, such as nicotine or flavoring. The interface can also store tobacco cut filler material impregnated with the additive or in combination with the additive. According to another exemplary embodiment, the interface 104*a* can be additive-free based on a location and/or amount of additives present in another portion or area of the smoking article. In an exemplary embodiment, the interface 104*a* has no material for filtering the mainstream smoke passing from the burn end 101 to the mouth end 103 of the smoking article 100. The interface 104*a* can be of any length suitable for storing a desired amount of additive. For example, according to an exemplary embodiment, the interface 104*a* has a length greater than 0 mm up to 3 mm. The interface 104*a* is established opposite the burn end 101 of the burn portion 102 through the portion of the wrapping paper overlapping the opposite end 107 of the burn portion 102. A small amount of material such as cellulose acetate, polypropylene, or paper, can be used as a cap or plug 109 on the open end 111, which corresponds to the mouth end 103, of the interface 104*a* after the additive has been disposed. Even with the addition of the filter-type material, the filtering characteristics or properties of the interface 104*a* with respect to the mainstream smoke can be negligible and/or non-existent depending on the packing density of the material disposed therein. For example, the amount of particle filtration performed by the interface 104*a* is directly proportional to the packing density of material disposed in the interface 104*a*. Moreover, the material disposed in the interface 104*a* can also be used to adjust a draw resistance of the smoking article as desired. A smoking tip 113 can be used during smoking of the smoking article 100. For example, the end 111 of the interface 104*a* can be inserted into an open end 115 of the smoking tip 113. The open end 115 of the smoking tip 113 having a diameter suitable for receiving and securing the smoking article via surface friction. Inserting the smoking article 100 into the open end 115 of the smoking tip 113 may require a small force (e.g., minimum amount of force necessary to urge the mouth end 103 of the smoking article into the open end 115 of the smoking tip 113) in the direction (e.g., see arrow) of the open end 115 in combination with rotation of the smoking article 100.

According to another exemplary embodiment, the smoking tip 113 can be formed from any known material such as wood, plastic, composites, or any other suitable material for oral use. The smoking tip 113 can be formed using an injection molding manufacturing process. The smoking tip 113 can also include an orthonasal property whereby an additive such as flavor and/or aroma can be discharged from a surface 118 of the smoking tip 113 to the adult smoker for enhancing the smoking experience. For example, the orthonasal property can have a mouth end 116 for passing smoke to the adult smoker. The orthonasal property can be formed on the surface 118 in an area of the mouth end 116 as a ring, segment, patch, line or other suitable feature as desired. The orthonasal property can be integrated into the surface of the smoking tip 113 during the injection molding process or added to the surface 118 post manufacturing by known processes (e.g., patch, spray, baking, curing, etc.). The additive can include at least one of an aroma and flavor compound corresponding to (e.g., substantially the same as, substantially similar to, or complementary to) and/or simulating the aroma of the additive flavor disposed in the burn portion 102 and/or mouth portion 104 of the smoking article.

Figure 2A:
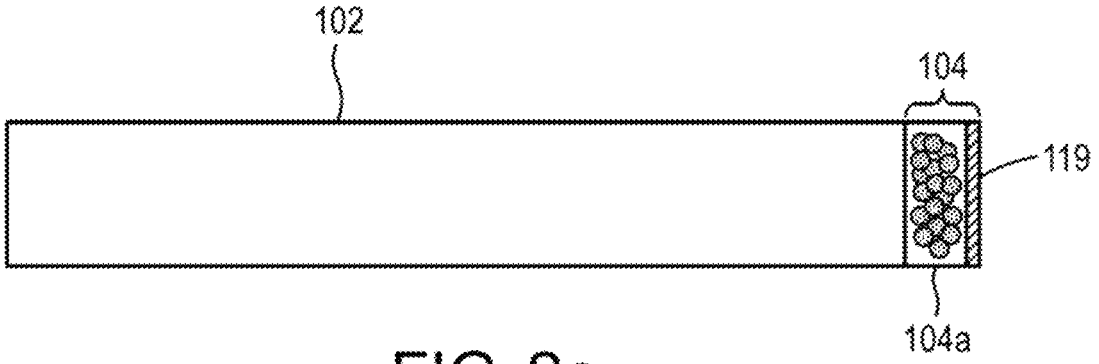
FIGS. 2*a*-2*c* illustrate an interface filled with an additive in accordance with an exemplary embodiment of the present disclosure.
Figure 2B:
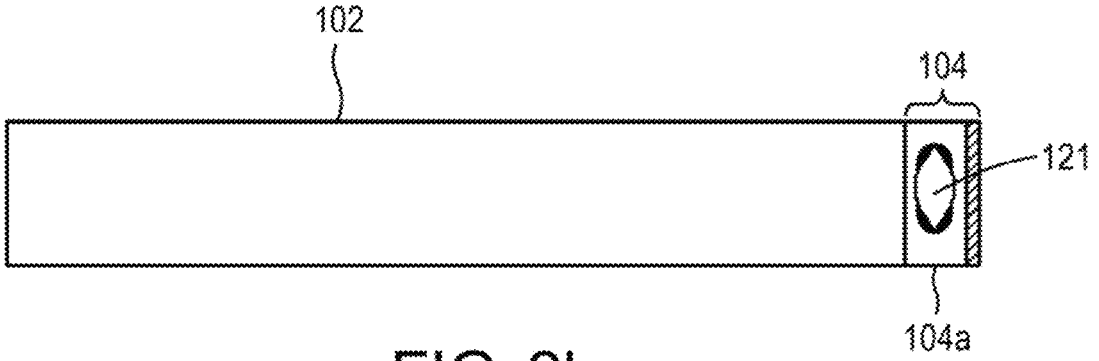
Figure 2C:
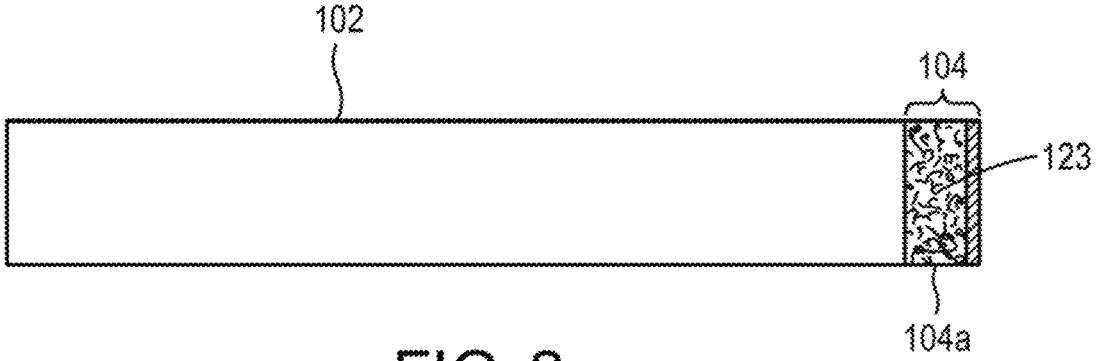

FIGS. 2*a*-2*c* illustrate an interface of the smoking article releasably storing an additive in accordance with an exemplary embodiment of the present disclosure. FIG. 2*a* illustrates the interface 104*a* releasably storing a plurality of flavor and/or nicotine beads or capsules 119. FIG. 2*b* shows the interface 104*a* releasably storing a single bead or capsule 121. FIG. 2*c* illustrates the interface filled with material 123, such as tobacco filler material, cellulose acetate, polypropylene, or paper, or other suitable material as desired that is impregnated with a liquid additive such as nicotine and/or flavor.

The smoking material 106 can be processed to include additives including any combination of nicotine, flavorants, or diluents including propylene glycol, glycerine, water, ethanol, and any other suitable form as desired. According to an exemplary embodiment of the present disclosure, the smoking material 106 can be impregnated with an additive consisting essentially of nicotine (e.g., e-liquid) as the only additive. The nicotine is added and/or injected into the smoking material 106 in sufficient quantities to realize a per puff nicotine content of 0.01 to 0.015 mg as found in cigarettes containing tobacco. The smoking material can be encased or wrapped with known wrapping material used in tobacco cigarettes. For example, the wrapping material 105 can include paper having an adhesive 108 (FIG. 1*c*) for holding the seams of the wrapping material together.

According to another exemplary embodiment, the smoking material 106 can remain in its natural state where no additives including nicotine are added. The additives can instead be present in the interface 104*a*. For example, the interface 104*a* can be filled at least partially with cellulose acetate, polypropylene, or paper material that is impregnated with a liquid additive consisting essentially of nicotine and/or flavor. Nicotine and/or flavor impregnation can occur prior to or after the fiber is disposed (e.g., placed) in the interface.

FIG. 1*b* illustrates a second smoking article in accordance with an exemplary embodiment of the present disclosure. The smoking article 100 of FIG. 1*b* includes a burn portion 102 and a mouth portion 104. The mouth portion 104 includes the interface 104*a* and a filter plug 104*b* formed of cellulose acetate fiber or any other suitable filtering material as desired.

FIG. 1*c* illustrates an exploded view of the second smoking article in accordance with an exemplary embodiment of the present disclosure. As shown in FIG. 1*c*, the mouth portion 104 includes the filter plug 104*b* that can be wrapped (e.g., covered) with tipping paper 112. A layer of plug wrap 114 can be applied on the filter plug 104*b* adjacent an inner side of the tipping paper 112. The tipping paper 112 extends past an edge of the filter plug 104*b* and overlaps the mouth portion 104 and the smoking rod 102 so that the two sections are held together. The interface 104*a* of the mouth portion 104 is established via the empty volume between the adjacent ends 117 of the burn portion 102 and the filter plug 104*b*. Because the end 120 of the filter plug 104*b* forms the mouth end 103 of the smoking article 100, the cap or plug 109 is not needed for the interface 104*a*. Both the tipping paper 112 and the plug wrap 114 can have an adhesive seam 116 for holding the seams of the tipping paper 112 and the plug wrap 114 together. The plug wrap 114 can also include an inner adhesive line 118 for adhering to the filter plug 110.

The mouth portion 104 of the smoking article 100 can include any of the variety of fibrous material suitable for use as filter elements in a traditional tobacco cigarette. The fibrous material can include cellulose acetate, polypropylene, paper, or any other suitable material as desired. The mouth portion can include one or more fibrous material plugs. In a configuration having two or more plugs, a void or hollow space can be formed between adjacent plugs. It should be understood that any of the additives used to reduce or eliminate constituents of the mainstream smoke can be omitted as needed because the cellulose smoking material does not generate any toxic materials or at the very least generates far fewer toxic materials or percentage of toxic materials over traditional tobacco cigarettes when burned.

Exemplary filter structures can include, but are not limited to, a mono filter, a dual filter, a triple filter, a single or multi cavity filter, a recessed filter, a free-flow filter, combinations thereof, or any other suitable filter structure or configuration as desired. Mono (e.g., single) filters can include cellulose acetate tow or cellulose paper materials. Dual filters can include a cellulose acetate mouth end and a pure cellulose or cellulose acetate segment. The length and pressure drop of the segments in a dual filter may be adjusted to maintain acceptable draw resistance. Triple filters may include mouth side and non-tobacco smoking material as side segments, and a middle segment comprising paper. Cavity filters include at least two segments, e.g., acetate-acetate, acetate-paper or paper-paper, separated by at least one cavity. Recessed filters include an open cavity on the smoking end. The filters can also be disposed in a mechanically rotatable filter portion where flavor is released based on the pressure applied to the filter during rotation.

According to an exemplary embodiment of the present disclosure, the filter wrap 114 and/or tipping paper 112 can have an orthoonasal property or characteristic 124 (FIG. 1*b*). For example, the tipping paper 112 is processed with an additive so that a flavor and/or an aroma or scent emanates from the surface of the tipping paper 112. The tipping paper 112 and/or filter wrap 114 can include additives that discharge at least one of an aroma and flavor compound corresponding to (e.g., substantially the same as, substantially similar to, or complementary to) and/or simulating the aroma of the additive flavor disposed in the burn portion 102 and/or mouth portion 104 of the smoking article. The orthonasal property 124 (FIG. 1*b*) can be formed wholly or partially in the filter wrap 114 and/or tipping paper 112. According to an exemplary embodiment of the present disclosure, the orthonasal property 124 can be formed on the filter wrap 114 and/or tipping paper 112 as a ring, segment, patch, line, or other suitable feature as desired. As such, the tipping paper 112 can further enhance the smoking experience by simulating or enhancing the flavor contained in the filter portion 104 prior to and/or during smoking.

Various filter constructions known in traditional tobacco cigarettes similarly can be used in connection with the exemplary smoking articles of the present disclosure, in which one or more flavor capsules may be incorporated. According to another exemplary embodiment, the filter constructions according to present disclosure can be additive-free based on a location and/or amount of additives present in another portion or area of the smoking article.

Figure 3:
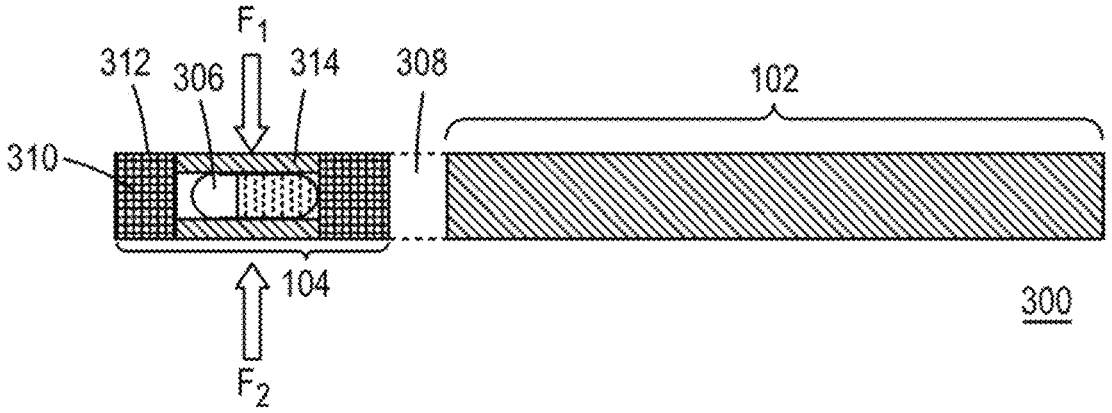
FIG. 3 illustrates a cross-sectional view of a smoking article having an interface and a flavor capsule in the filter portion in accordance with an exemplary embodiment of the present disclosure.

FIG. 3 illustrates a cross-sectional view of a smoking article having a capsule in the filter portion in accordance with an exemplary embodiment of the present disclosure. As shown in FIG. 3, the smoking article 300 includes a mouth portion 104 having a flavor capsule 306 including additive material, such as flavorant. The mouth portion 104 can be attached to the burn portion 102 where the mouth portion 104 includes a filter having a multi-plug design. For example, the mouth portion 104 can include along a length of the smoking article, an interface 308, which stores a liquid additive such as nicotine and/or flavor impregnated within or coated on material such as cellulose acetate, polypropylene, or paper. The interface 308 is adjacent the burn portion 102 and includes filter plugs 310, 312. According to another exemplary embodiment, the interface 308 can store an additive in the form of a one or plural beads or capsules. The additive bead or capsule 306 can be located between the filter material regions 310, 312. The additive bead or capsule 306 can be frictionally fitted in a hollow acetate tube 314.

For on-demand release of the additive, an area of the mouth portion 104 can be squeezed with forces $F_1$, $F_2$ on either side of the additive capsule 306. The applied forces cause at least partial rupture of the bead or capsule 306, thereby releasing the additive component to saturate or impregnate the filter plugs 310, 312. As the smoking article 300 is smoked, the additive released by the additive capsule 306 can be exposed to mainstream smoke passing through the mouth portion 104.

Figure 4:
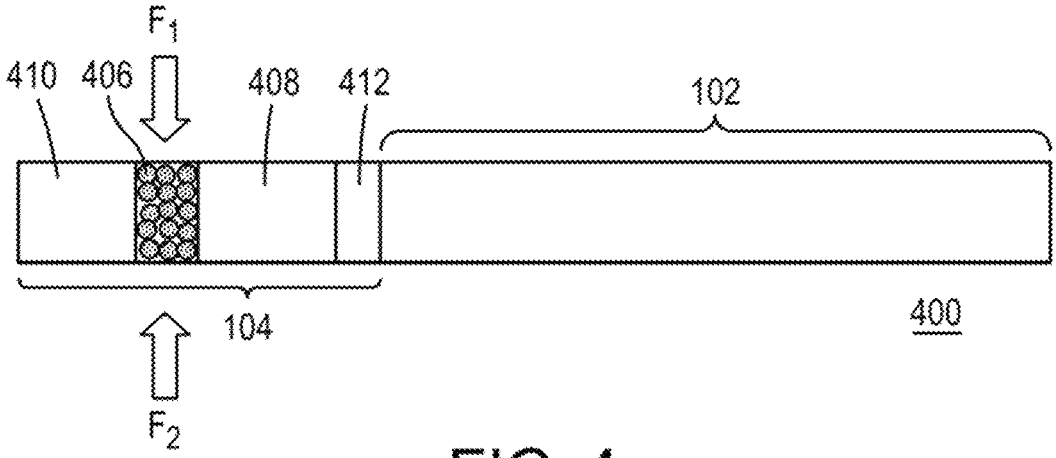
FIG. 4 illustrates a cross-sectional view of a smoking article having an interface and a plurality of flavor microcapsules in the filter portion in accordance with an exemplary embodiment of the present disclosure.

FIG. 4 illustrates a cross-sectional view of a smoking article having microcapsules in the filter portion in accordance with an exemplary embodiment of the present disclosure. As shown in FIG. 4, the smoking article 400 can include a burn portion 102 and mouth portion 104. The mouth portion 104 can have a multi-plug filter design that includes filter plugs 408 and 410 where filter plug 408 is adjacent the burn portion 102 and filter plug 410 is on the mouth end 103. The filter portion 104 can include flavor capsules 406 in the form of one or more microcapsules which encapsulate additive(s), such as flavorant. Each microcapsule 406 may be used alone or in combination with other microcapsules 406. When used in a smoking article 400, each microcapsule can contain the same or different additives from other microcapsule(s) in the smoking article 400, where applicable, depending upon the desired additive(s) or flavor. The smoking article 400 can also include an interface 412 for releasably storing a liquid additive such as nicotine and/or flavor impregnated in a material, such as cellulose acetate, polypropylene, or paper, or provided in one or more beads or capsules. The additive provided in the interface 412 can be used in combination with or as a substitute for like additives provide in the smoking material 106 of the burn portion 102.

Figure 5:
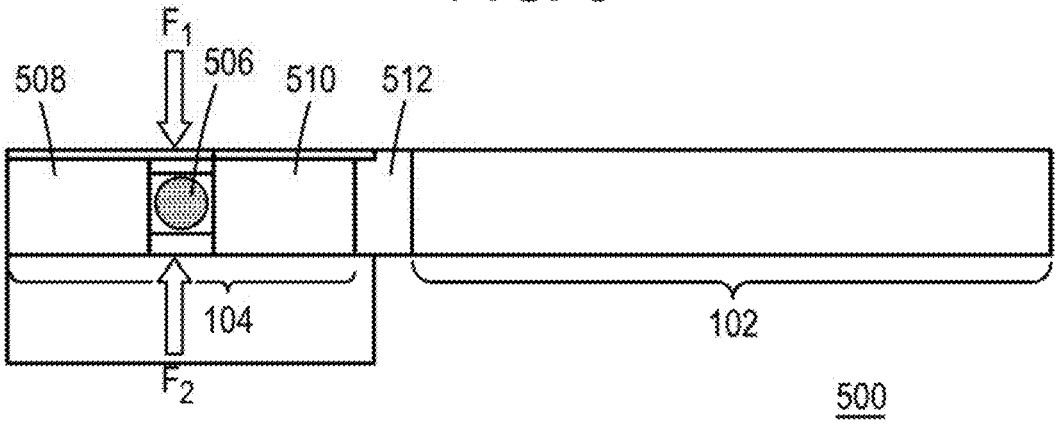
FIG. 5 illustrates a cross-sectional view of a smoking article having an interface and a flavor macrocapsule in the filter portion in accordance with an exemplary embodiment of the present disclosure.

FIG. 5 illustrates a cross-sectional view of a smoking article having one or more macrocapsules in the form of additive spheres 506 in the mouth portion in accordance with an exemplary embodiment of the present disclosure. As illustrated in FIG. 5, the macrocapsule 506 may be located in the filter 504 downstream from filter plug 510.

On-demand release of the additives from the microcapsules 406 of FIG. 4 or macrocapsules 506 of FIG. 5 can be achieved by squeezing with force on either (e.g., one or both) side(s) of the mouth portion 104 that contains the microcapsules 406 or macrocapsules 506, respectively. By applying the force ($F_1$, $F_2$), one or more of the microcapsules 406, 506 can be ruptured and the additive(s) contained therein would be released into the filter of the mouth portion 104 of the smoking article 400, 500. Thus, the additive(s) are released within the mouth portion 104 only after force is applied, providing on-demand delivery of flavorant.

As discussed in U.S. Pat. No. 7,578,298, the content of which is hereby incorporated by reference in its entirety, use of flavor capsules provides a number of advantages for supplying an additive component to the smoking article. Migration of the additive is minimized due to the use of a capsule which retains the additive in a primary reservoir or within the microcapsules until use. The flavor capsules provide a protective structure to prevent or minimize the migration of the additive component during storage into other parts of the smoking material. The location of the flavor capsules in the filter also minimizes loss of flavor to side stream smoke.

The additive which is released from the additive capsules or beads upon squeezing or applying external force thereto may be supplied in any amount desirable for the particular type of additive used. The amount may be determined by the specific design of the additive capsules or beads, for example the first part of a two-part capsule serves as the primary reservoir for the additive component, or the number and size of the microcapsules present in the filter. The amount of additive used per smoking article can be extremely small since the additive is substantially sealed in the capsules during packaging and storing of the smoking article. An appropriate and/or desired amount of flavor and/or nicotine can be released into the smoking article via the capsules. For example, when the capsules can release the additive in a small range, e.g., 3-6, 6-9, 9-12 microliters, or large range, e.g., 6-9, 9-12, or 12-15 or more microliters. The amount of additive (e.g., flavor and/or nicotine) released in the smoking article can be controlled by the adult smoker based on at least the number and/or size of capsules preloaded into the mouth portion, the force applied to the mouth portion to release the additive, and/or a number of sequentially applied forces.

The additive capsules may be of any size suitable for use in the smoking article. The smoking article described herein is of substantially similar size and shape as a traditional tobacco cigarette. Therefore, the additive capsules can have a diameter that is less than the diameter of the smoking article, e.g., less than 2 mm, 2 to 3 mm, 3 to 4 mm, 4 to 5 mm or greater than 5 mm, and can vary in length depending on the length of a filter in the mouth portion 104, e.g., less than 8 mm, 8-10 mm, 10-12 mm, or more than 12 mm. The additive capsule of FIG. 4 can be of sufficient size, e.g., about 2 to 4 mm in diameter and about 8-11 mm in length, to allow for a desired amount of liquid additive component to be held within the multi-part capsule while the multi-part capsule also fits into the filter and provides a conveniently large target for the adult smoker to apply force.

The two-part capsule can be placed in a hollow tube, by way of example, a hollow acetate tube, having an external diameter similar to that of a traditional cigarette filter. The placement of the capsule may be such that there is filter material at both ends of the hollow tube as shown in FIGS. 3 and 4 or the hollow tube containing the capsule may be placed at a mouth end 103 of the mouth portion 104. Additionally, the orientation of the two-part capsule may be such that the portions of the capsule where force is applied are located within the axial circumference of a filter within the mouth portion 104, while the direction of the additive release is oriented toward the mouth portion 104 on the burn portion 102 end of the mouth portion 104. It is noted that the orientation allows for access to applying force to the portions of the capsule designed to release additives upon the application of force.

To provide one or more microcapsules and/or macrocapsules in a mouth portion 104 of the smoking article in accordance with an exemplary embodiment described herein, the microcapsules can be the same or different sizes. For example, microcapsules can be made with rounded shapes having diameters from 0.3 to 1.0 mm. According to an exemplary embodiment the microcapsules can be provided with diameters of about 0.3 to 0.4 mm. According to another exemplary embodiment of the present disclosure, the microcapsules can be provided in the form of round seamless capsules with diameters of about 0.3 to about 0.4 mm. In accordance with an exemplary embodiment of the present disclosure, macrocapsules can have rounded shapes, such as round, seamless singular part with diameters of 1.0 to 6.0 mm. According to another exemplary embodiment, the macrocapsules can have a diameters from 3.0 to 4.0 mm. Round microcapsules and macrocapsules with these size ranges allows for the effect on the resistance to draw by the microcapsules and/or macrocapsules to be minimal and can be compensated for by a smoking article having a loosely packed or reduced packing tightness of smoking material in the burn portion 102 or the filter components (e.g., filter plugs) of the mouth portion 104.

Microcapsules having a diameter of about 0.35 mm packed in a hollow tube with a diameter of about 8 mm allow the hollow tube to achieve about 90% fill without a substantial change in the resistance to draw. It is also noted that microcapsules smaller than 0.3 mm diameter capsules may be used, however, if these smaller microcapsules are used, they are dispersed in filter tow material in the filter, rather than in a cavity, as the smaller size may lead to tighter packing and may lead to a substantial increase in the resistance to draw if packed in a hollow tube portion of a filter.

As illustrated in FIG. 4, microcapsules 406 (or single macrocapsule in FIG. 5) can be provided through a portion of the depth, width and length of mouth portion 104. The microcapsules 406, similar to the placement for the two-part capsule, can then be placed in a hollow tube 408 such as a hollow acetate tube establishing an external diameter of the filter portion 104.

Figure 6:
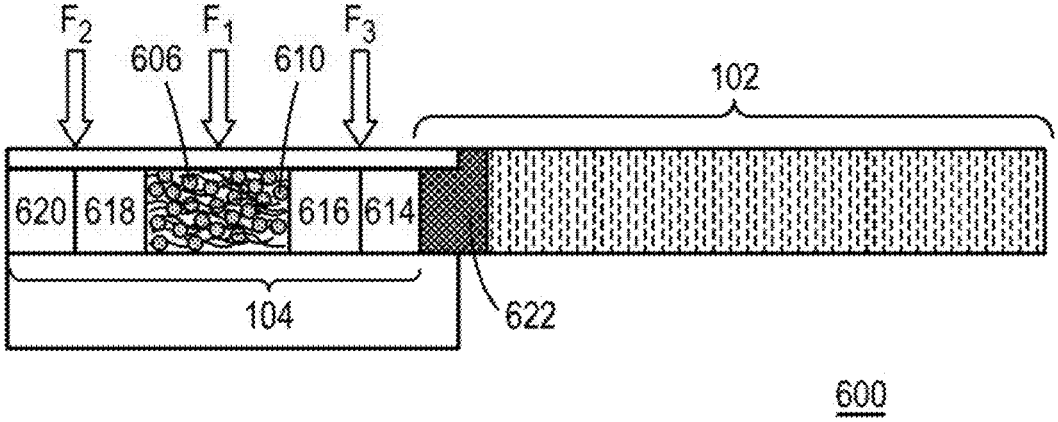
FIG. 6 illustrates a cross-sectional view of a smoking article having an interface and flavor microcapsules embedded in filter material in the filter portion in accordance with an exemplary embodiment of the present disclosure.

FIG. 6 illustrates a cross-sectional view of a smoking article having a flavorant beads embedded in filter material in the filter portion in accordance with an exemplary embodiment of the present disclosure. In accordance with yet another exemplary embodiment of the present disclosure, microcapsules 606 can also be within the filter plug 610 of the mouth portion 104. The filter plug 610 can be sandwiched between one or more filter plugs on each side, such as filter plugs 614, 616 on a burn portion 102 end of the mouth portion 104 and filter plugs 618, 620 on a mouth end 103 of the mouth portion 104. The smoking article 600 can also include an interface 622 storing a liquid additive such as nicotine and/or flavor along with cellulose acetate tow. The nicotine and/or flavor is provided as an additive in the interface 622, can be used a substitute or in combination with the additives (e.g., nicotine and/or flavor) provided in the smoking material provided of the burn portion 102. The force ($F_1$, $F_2$, $F_3$) can be applied along the length of the hollow acetate tube 612 of the filter portion 104 for on-demand release of the flavor additive into the smoking article 600. For example, if a force is applied in the area of $F_1$, the additives can be released proportional to the applied force in the directions of filter plugs 614, 616 and 618, 620. If, a force is applied in the area of $F_2$, the additives can be released in a direction toward filter plugs 614, 616. If a force is applied in the area of $F_3$, the additive can be released in a direction toward filter plugs 618, 620. Thus, according to an exemplary embodiment of the present disclosure, on-demand release of the flavoring in filter plug 610 can be controlled (e.g., direction and amount of additive flow) based on the location or area along the mouth portion 104 at which a force ($F_1$, $F_2$, $F_3$) is applied.

According to an exemplary embodiment of the present disclosure, the smoking article can include a deodorant that is releasably stored as an additive in the filter portion 104. The deodorant can be releasably stored in a crushable bead or capsule of a hollow tube as described in accordance with FIGS. 3-6. The deodorant can be in liquid or powder form and includes a base or acidic material, or a combination thereof (e.g., baking soda), which when released can disintegrate quickly and eliminate the odor and/or smell generated by a cigarette butt. An adult smoker can release the deodorant on-demand by applying a force F to the capsule or bead as shown in FIGS. 3-6. Further, the adult smoker would not desire the deodorant being released or having any impact on the smoking experience. Therefore, when a deodorant is present in the mouth portion 104, no other flavor or nicotine additives are present in the mouth portion 104. Rather, all flavor and/or nicotine additives can be releasably stored in the interface. According to another exemplary embodiment, the nicotine can be embedded in the smoking material of the burn portion 102, and all flavor additives can be releasably stored in the exemplary interface as described herein.

Figure 7A:
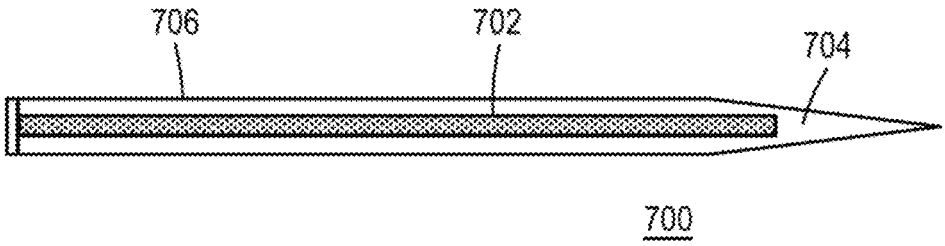
FIGS. 7*a*-7*c* illustrate a smoking article having an additive insert in the smoking rod in accordance with an exemplary embodiment of the present disclosure.
Figure 7B:
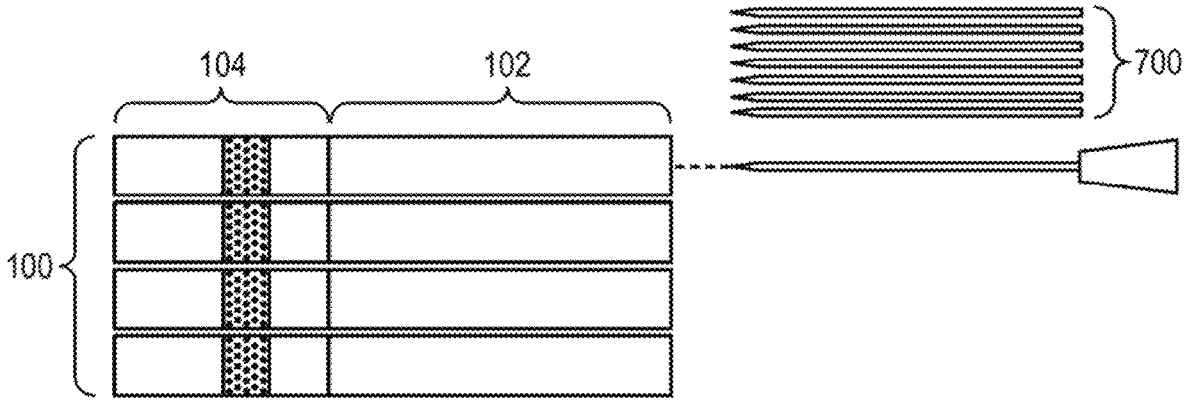
Figure 7C:
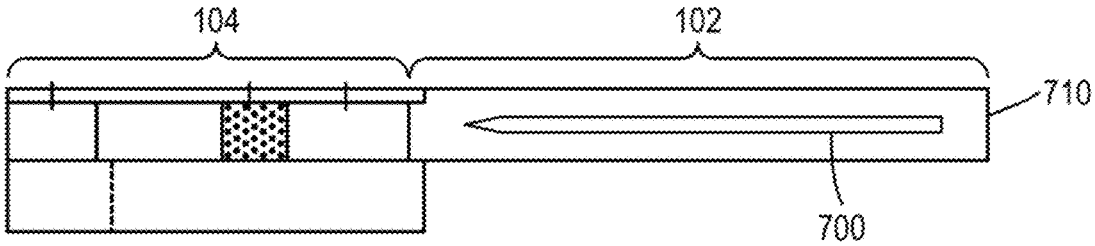

FIG. 7*a*-7*c* illustrate a smoking article having an additive insert in the smoking rod in accordance with an exemplary embodiment of the present disclosure.

As shown in FIG. 7*a*, delivery of additives (such as nicotine and/or flavor) in the smoking article can be provided through thermally degradable, robust immobilized additive inserts 700. By providing additives in the form of thermally degradable immobilized additive inserts, migration and/or loss of the additives in a smoking article prior to smoking can be reduced. Moreover, additives 702 can be immobilized within a cavity 704 of a rod 706 of the insert 700. Given this construction, the insert 700 can reduce the loss of the additives as the inserts protect the additives from escaping to the environment. Additives such as nicotine and/or flavor can be added to smoking articles to provide characteristics of the additives in the smoking articles. Suitable insert materials can include cellulose, cellulosic, or cellulosic derived materials (e.g., wood, bamboo, paper-based, or any other suitable material as desired). For example, a cellulosic material rod can be provided, wherein the additives can be immobilized therein. Suitable rod materials include, but are not limited to, cellulosic materials such as paper, fibers, or any other known or suitable material as desired.

As shown in FIG. 7*b*, a nicotine-containing insert 700 would be inserted during the manufacturing process into the burn portion 102 of a smoking article 100. When burned, the insert material ashes/decomposes along with the cigarette as it is burned. Nicotine, either in its nonprotonated and/or protonated forms, could be incorporated into the insert neat or in combination with humectants and/or other flavorants. The protonated forms of nicotine offer the advantage of being less volatile and more stable to chemical degradation during storage. Alternatively, the nonprotonated form of nicotine could be used as well.

The exemplary smoking article of FIG. 7*c* includes a burn portion 102 and a mouth portion 104. The burn portion 102 includes a thermally degradable, robust insert 700, which contains one or more immobilized additives, within the smoking material or smoking rod. The insert 700 is sufficiently robust such that the inserts are capable of maintaining their structure when machine inserted into the smoking rod. As already discussed, the insert 700 includes a cavity 704 having one or more additives 702 provided therein. The inserts 700 containing one or more immobilized additives can be machine inserted into a smoking article 700 to provide additives to smoking articles. By providing inserts 700 for smoking articles, the additives are immobilized within the inserts 700 to reduce interaction between the additives and either the environment or other areas within or the smoking articles.

To release the additives, the inserts 700 can be provided in a heating zone of the burn portion 102. As a result, as the mainstream smoke passes through the burn portion 102 from the burn end 710, the inserts 700 can be heated to at least a partially degraded state, thereby releasing the additives into the smoking material. In particular, the inserts can be thermally heated and/or pyrolyzed in the smoking material of the burn portion resulting in release of the additive from the insert. As used herein, "heated" or "heating" is intended to include elevating the temperature of an insert to the point at which volatilization, thermal degradation, combustion, pyrolyzation, or other known chemical reaction due to heating occurs such that the insert releases additives through at least partial degradation of at least a portion of the insert. For example, according to an exemplary embodiment described herein, temperatures between 50° C. and 900° C., or between 100° C. and 800° C. can be used for thermally degrading the insert, as well as mobilizing the additives and releasing the additives from the inserts. In accordance with yet other exemplary embodiments temperatures above 50, 100, 200, 300, 400, 500, 600, 700, 800° C. can be used based on various material and structural properties of the insert 700, and/or position within the smoking rod 102. Consequently, without the application of heat, the additive remains immobilized within the inserts and is therefore substantially prevented from interacting with smoking material within the burn portion 102, any other portion of the smoking article, or with the environment.

The level of additives in inserts 700 can be widely varied depending upon the methods of forming the inserts, the weight and infusibility of the additives, the weight and capacity of the containment portion of the inserts, etc. The amounts of the additives in the inserts 700 can be determined based upon the loading capacity of the inserts 700 and the levels of immobility of the additives within the inserts. In exemplary embodiments, each insert includes between 5 and 50 mg of additives.

The inserts containing one or more immobilized additives as described herein, can be formed by trapping or immobilizing additives within elongated devices. Exemplary methods include: 1) forming inserts by infusing additives into the inserts under high pressure; 2) forming inserts by filling cavities in inserts with additives; 3) forming inserts by encapsulating additives within inserts; 4) infusing additives by vacuum infiltration, as well as 5) combinations of any of these.

According to exemplary embodiments of the present disclosure, the immobilized additive inserts 700 are thermally degradable such that an application of heat can release the additives. Additionally, the inserts 700 containing one or more immobilized additives are sufficiently robust and at least somewhat rigid to allow for machine insertion of the inserts into smoking rods of smoking articles and to allow the inserts 700 to maintain their structure without breaking or losing their original shape.

The inserts 700 containing one or more immobilized additives can be provided as elongated devices with additives therein, such that the shape of the insert 700 can fit within a smoking article. The term "elongated device" is intended to include any device made of a shaped material with: 1) sufficient additive carrying capacity; 2) suitable decomposition properties; and 3) suitable robustness or strength. For example, an elongated device should have 1) sufficient additive carrying capacity, such that sufficient amounts of additives can be provided within the elongated devices. Additionally, the elongated device should have 2) suitable decomposition properties, such that the elongated devices are combusted or decomposed at approximately the same rate as the smoking article. Also, the elongated device should have 3) suitable robustness or strength, such that the elongated devices can withstand machine insertion into a smoking rod without breaking and can withstand mechanical manipulation for additive loading, such as cavity formation, pressurized injection of additives, etc.

Exemplary shapes for the inserts include cylinders, tapered rods, cones, etc., wherein the transverse cross-sectional areas can have any shape, such as circular, triangular, square, etc. The shapes can include geometries that are compatible with other desired characteristics. For example, a tapered insert can be provided with a narrow end closer to the mouth end of a smoking article and described herein and a wide end closer to the burn end of the smoking article, such that more additive can be thermally released closer to the burn end of the smoking article. By positioning more additive closer to the burn end of the smoking article, a first puff can have more additive therein than a second puff. The structure and location within the smoking article of the additive insert reduces and/or eliminates bad mouth feel, after taste, and bad breath, or any combination thereof. Furthermore, given the material composition, the additive insert burns cleanly such that there is negligible residue after smoking and negligible toxic constituents or byproducts are produced in the mainstream or sidestream smoke when the smoking material and additive insert are thermally heated and/or pyrolized.

Additionally, the elongated devices can be shaped such that the length and width are sized for use in specific smoking articles. According to exemplary embodiments of the present disclosure, inserts can be provided that are round or oval in cross section, slightly shorter in length and smaller in diameter than smoking rod portions of smoking article.

The exemplary inserts as described herein may be used in any smoking articles described according to any other exemplary embodiment (e.g., FIGS. 1-6) of the present disclosure. When using the inserts in combustible smoking articles, the inserts can preferably have a rate of combustion approximating the rate of combustion of the smoking rod in the smoking articles.

Figure 8A:
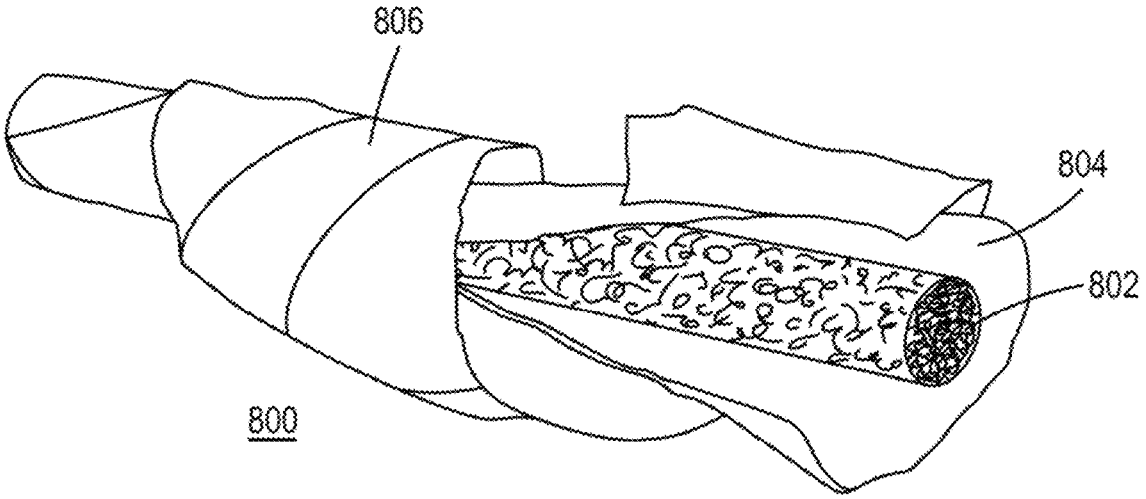
FIGS. 8*a* and 8*b* illustrate a smoking article formed as a cigar in accordance with an exemplary embodiment of the present disclosure.
Figure 8B:
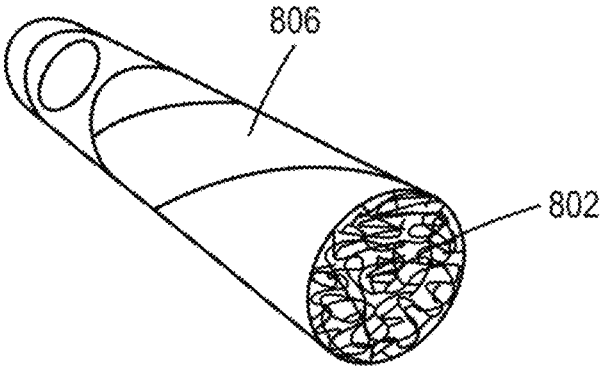

FIGS. 8*a* and 8*b* illustrate a smoking article formed as a cigar in accordance with an exemplary embodiment of the present disclosure. As shown in FIGS. 8*a* and 8*b*, the smoking article 800 can be in the form of a cigar having a smoking material 802, a binder 804, and a wrapper 806. The smoking material 802 can be formed as a tobacco-less material, such as, a biopolymer material including cellulose. According to an exemplary embodiment of the present disclosure, the smoking material 802 can include a cellulose material consisting essentially of high purity cotton or cotton-based material or any other cellulosic material or cellulosic-derived material described herein. The smoking material 702 can be impregnated with one or more additives (e.g., nicotine, flavour, diluent, humectant), as already discussed. According to an exemplary embodiment, the smoking material is impregnated with an additive consisting essentially of nicotine. The wrapper 706 can be formed of any known casing materials, such as a material consisting essentially of tobacco. According to yet another exemplary embodiment, an additive insert can be inserted into the smoking material 802 of the cigar 800, such that when heated to at least a partially degraded state, the insert releases the additives into the smoking material 802.

Figure 9A:
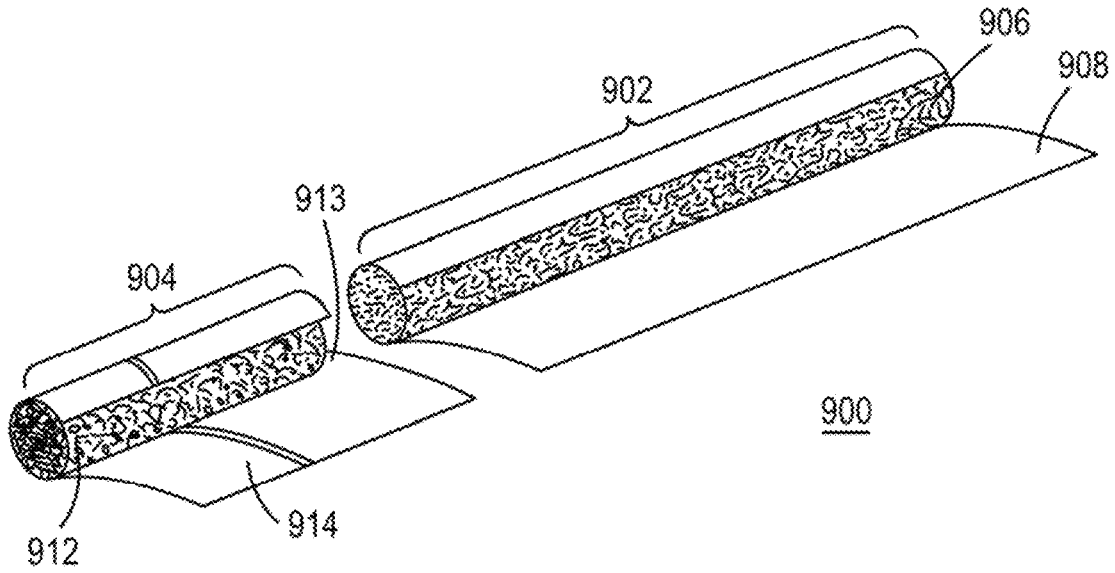
FIGS. 9*a* and 9*b* illustrate a smoking articled formed as a cigarillo having an interface in the filter portion in accordance with an exemplary embodiment of the present disclosure.
Figure 9B:
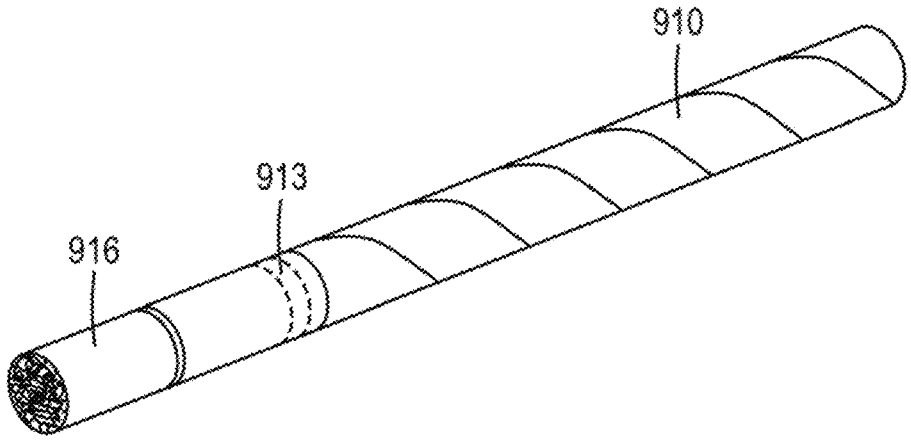

FIGS. 9*a* and 9*b* illustrate a smoking article formed as a cigarillo in accordance with an exemplary embodiment of the present disclosure. As shown in FIGS. 9*a* and 9*b*, the smoking article can be formed as a cigarillo 900 and include a cylindrical burn portion (e.g., smoking rod) 902 and a mouth portion 904. The burn portion 902 can be filled with a smoking material 906 consisting essentially of cellulose, such as high purity cotton or cotton-based material or any other cellulosic material described herein. The smoking material can be impregnated with a liquid additive, such as nicotine and/or flavor as described in other embodiments of the present disclosure. According to yet another exemplary embodiment, an additive insert can be inserted into the burn portion 902 of the cigarillo 900, such that when heated to at least a partially degraded state, the insert releases the additives into the smoking material 906 of the cigarillo 900. The burn portion 902 can be covered with an inner binder 908 and an outer wrapper 910. The mouth portion 904 can include a filter plug 912 formed of cellulose acetate tow and an interface 913. The filter plug 912 can be wrapped with plug paper 914. Tipping paper 916 can be wrapped around the filter plug 912 on an outer surface of the plug paper 914. The tipping paper 916 can include suitable adhesive portions (not shown) at the seams so that when wrapped around the filter plug 912 the tipping paper overlaps on one end such that can securely attach the filter portion 804 to the burn portion 902. The space established between adjacent ends of the filter plug 912 and the burn portion 902 forms the interface 913. The filter plug 912 can be impregnated with additives, such as a liquid, or house one or more beads or capsules as described herein, to enhance the smoking experience of the adult smoker. According to another exemplary embodiment, the interface 913 can introduce additives in the form of beads or capsules, or as a liquid including additive material such as nicotine and/or flavor. According to an exemplary embodiment, the flavour and/or nicotine additives of the interface 913 can be used in combination with or in place of flavor and/or nicotine additives used in the filter plug 812.

According to yet another exemplary embodiment of the present disclosure, a method of making smoking articles includes depositing tobacco-less or non-tobacco smoking material or a tobacco substitute, such as a cellulose material consisting essentially of pure cotton or cotton-based material or any other cellulosic material described herein, in a cigarette-making machine to form smoking material or the smoking material can be processed in a pre-fabricated form (e.g., cotton rod, filament); placing a paper wrapper around the cotton column to form a burn portion (e.g., smoking rod); and attaching a mouth portion to the burn portion to form the smoking article. The filter portion is attached to the burn portion such that a space is formed between the two parts. The space establishing an interface within which additives, such as flavoring and nicotine, can be releasably stored during smoking to enhance the experience for the adult smoker. The smoking material is injected with an additive consisting essentially of a liquid, such as nicotine and/or flavor. Alternatively, an additive insert containing an immobilized additive, such as nicotine and/or flavor can be inserted into the smoking material or smoking rod of the burn portion. The filter is configured to have one more filter plugs, wherein the one or more filter plugs or a space between adjacent plugs is filled with flavor capsules, such as one or more microcapsules or macrocapsules, containing a desired flavor. Tipping paper is wrapped around the mouth portion and overlaps the smoking rod. The tipping paper is formed (e.g., processed) having a property or characteristic whereby an aroma or scent corresponding to and/or enhancing the flavor of the flavor capsules in the filter portion emanates from the tipping paper.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A smoking article comprising:
- a burn portion; and
- a mouth portion having a first end and a second end opposite the first end, the mouth portion including,
  - a filter including,
    - a first filter plug,
    - a second filter plug adjacent the first end, and
    - a third filter plug adjacent the second end such that the first filter plug is between the second filter plug and the third filter plug,
  - a first additive within the first filter plug, and
  - an interface between the filter and the burn portion, the interface configured to store a second additive.

2. The smoking article of claim 1, wherein the burn portion includes a smoking rod filled with a smokeable filler material consisting essentially of cellulose material.

3. The smoking article of claim 2, wherein the cellulose material is an ash-free material.

4. The smoking article of claim 2, wherein the smokeable filler material is formed from shredded ash-free cellulose filter paper.

5. The smoking article of claim 2, wherein the smokeable filler material includes a plurality of strips of cellulose fiber.

6. The smoking article of claim 5, wherein the cellulose material includes wood, jute, ramie, hemp, tree bark, cotton, cotton-based material, or any combination thereof.

7. The smoking article of claim 2, wherein the smokeable filler material of the smoking rod is encased in wrapping paper.

8. The smoking article of claim 7, wherein the smokeable filler material includes at least one pre-formed cellulose rod.

9. The smoking article of claim 2, wherein the smokeable filler material is impregnated with nicotine.

10. The smoking article of claim 2, wherein the smokeable filler material is impregnated with flavor.

11. The smoking article of claim 2, wherein the smokeable filler material is impregnated with flavor and nicotine.

12. The smoking article of claim 1, wherein the first additive includes a flavor, nicotine in liquid form, or both a flavor and nicotine in liquid form, and the first additive is releasably stored in a bead, a capsule, or both a bead and a capsule.

13. The smoking article of claim 1, wherein the second additive includes tobacco cut filler material, the first additive includes a flavor, nicotine in liquid form, or both flavor and nicotine in liquid form, and the first additive is releasably stored in a bead, a capsule, or both a bead and a capsule.

14. The smoking article of claim 1, wherein the second additive includes a flavor, nicotine, a tobacco cut filler material, or any combination thereof.

15. The smoking article of claim 14, wherein the second additive is in liquid form, stored in one or more beads, stored in one or more capsules, or any combination thereof.

16. The smoking article of claim 14, wherein the mouth portion includes an orthonasal property on a surface of the mouth portion, and the orthonasal property is configured to discharge a flavor, an aroma compound, or both a flavor and an aroma compound.

17. The smoking article of claim 16, further comprising:

a filter wrap, tipping paper, or both a filter wrap and tipping paper configured to cover the mouth portion, wherein the filter wrap, tipping paper, or both the filter wrap and tipping paper have the orthonasal property.

18. The smoking article of claim 17, wherein the orthonasal property is formed as a ring, a segment, a patch, a line, or any combination thereof on the filter wrap, tipping paper, or both the filter wrap and tipping paper.

19. The smoking article of claim 1, further comprising:

a fourth filter plug between the second filter plug and the first end; and a fifth filter plug between the third filter plug and the second end.

20. The smoking article of claim 1, wherein the first additive is releasably stored on-demand.

21. The smoking article of claim 1, wherein the second filter plug and the third filter plug include a third additive; and the first additive and the third additive are releasably stored on-demand by applying a force along a length of the filter.

22. The smoking article of claim 1, wherein the burn portion includes, a smoking rod filled with a smokeable filler material consisting essentially of cellulose material, and an elongated additive insert configured to be fully inserted into the smoking rod.

23. The smoking article of claim 22, wherein the elongated additive insert includes nicotine, a flavor, or both nicotine and a flavor.

* * * * *